US012414594B2

(12) United States Patent
Hetzel

(10) Patent No.: US 12,414,594 B2
(45) Date of Patent: Sep. 16, 2025

(54) RUNNING BELT

(71) Applicant: Amer Sports Canada Inc., North Vancouver (CA)

(72) Inventor: Ryan Hetzel, Squamish (CA)

(73) Assignee: Amer Sports Canada Inc., North Vancouver (CA)

( * ) Notice: Subject to any disclaimer, the term of this patent is extended or adjusted under 35 U.S.C. 154(b) by 656 days.

(21) Appl. No.: 17/688,321

(22) Filed: Mar. 7, 2022

(65) Prior Publication Data

US 2023/0276882 A1 Sep. 7, 2023

(51) Int. Cl.
*A41F 9/00* (2006.01)

(52) U.S. Cl.
CPC ..... *A41F 9/002* (2013.01); *A41D 2600/10* (2013.01)

(58) Field of Classification Search
CPC ..... A41F 9/00; A41F 9/002; A41D 2600/10; A45C 1/104
See application file for complete search history.

(56) References Cited

U.S. PATENT DOCUMENTS 1,418,371 A * 6/1922 Foster ..... A45C 1/04 224/587
1,651,921 A * 12/1927 Felz ..... A45C 1/04 224/587
4,461,030 A * 7/1984 Knudsen ..... A45C 1/04 2/22
4,462,116 A * 7/1984 Sanzone ..... A41D 20/00 2/253
4,501,028 A * 2/1985 Gottschall ..... A41F 9/002 2/338
4,525,879 A * 7/1985 Kalomeris ..... A45C 1/04 2/338
4,634,031 A * 1/1987 Frankhouse ..... A45C 1/04 224/602
5,558,440 A * 9/1996 Miller ..... A45F 5/00 224/663
6,311,336 B1 * 11/2001 Gootrad ..... A45C 11/22 224/257
8,028,345 B2 * 10/2011 Waite ..... A41D 1/14 2/220
8,321,964 B2 * 12/2012 Gernes ..... A41B 9/001 2/403
9,021,615 B2 * 5/2015 Cockram ..... A41D 13/0015 2/236
9,254,010 B2 * 2/2016 Hedrick ..... A41D 13/0017
9,961,947 B2 * 5/2018 Cockram ..... A41D 31/18
10,010,158 B2 * 7/2018 Do ..... A41D 27/205
10,687,604 B2 6/2020 Do
(Continued)

FOREIGN PATENT DOCUMENTS

EP 4241599 9/2023

*Primary Examiner* — Richale L Quinn
(74) *Attorney, Agent, or Firm* — Terence P. O'Brien; Todd A. Rathe

(57) ABSTRACT

An example running belt that may include a panel at least partially forming an enclosed volume having a mouth to receive articles. The panel has a front face and a folded edge portion. The running belt may further include a waist support to extend about the waist of a person wearing the running belt. The waist support may include a band backing the folded edge portion, wherein the folded edge portion is secured to the front face and wherein the band is secured to the folded edge portion.

20 Claims, 6 Drawing Sheets

(56) References Cited

U.S. PATENT DOCUMENTS

| | | | | |
|---|---|---|---|---|
| 10,932,529 | B2 * | 3/2021 | Mulfeld | A44B 11/006 |
| 11,291,257 | B2 * | 4/2022 | Epp Frenette | A41D 27/24 |
| D1,024,545 | S * | 4/2024 | Lin | D3/226 |
| 2008/0190980 | A1 * | 8/2008 | Overton | A45F 3/14 224/660 |
| 2013/0048687 | A1 * | 2/2013 | Do | A41F 9/00 224/191 |
| 2013/0048695 | A1 * | 2/2013 | Do | A45F 3/005 224/676 |
| 2013/0276210 | A1 * | 10/2013 | Clarke | A41D 1/14 2/220 |
| 2014/0196194 | A1 * | 7/2014 | Clarke | A41D 1/002 2/237 |
| 2016/0051035 | A1 | 2/2016 | Do | |
| 2016/0143424 | A1 * | 5/2016 | Stephens | A45F 3/005 224/676 |
| 2016/0331053 | A1 * | 11/2016 | Gordon | A41D 7/00 |
| 2017/0295870 | A1 | 10/2017 | Harris et al. | |
| 2018/0220720 | A1 | 8/2018 | Cockram | |
| 2018/0295972 | A1 * | 10/2018 | Do | A41F 9/00 |
| 2019/0269838 | A1 * | 9/2019 | Jablonski | A61M 60/857 |
| 2021/0235799 | A1 * | 8/2021 | Willows | A41D 27/20 |
| 2022/0160065 | A1 * | 5/2022 | Pagano | A41F 9/025 |
| 2023/0276882 | A1 * | 9/2023 | Hetzel | A41D 27/20 2/321 |
| 2023/0284757 | A1 * | 9/2023 | Gakovic | A45F 5/021 |
| 2023/0337809 | A1 * | 10/2023 | Wagner | A45F 5/021 |

* cited by examiner

FIG. 1
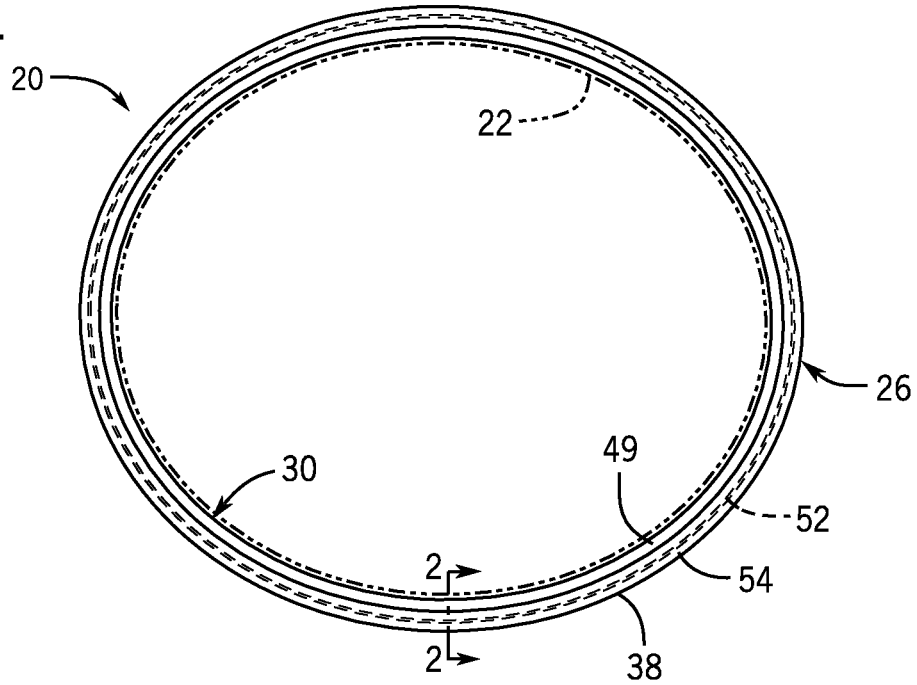
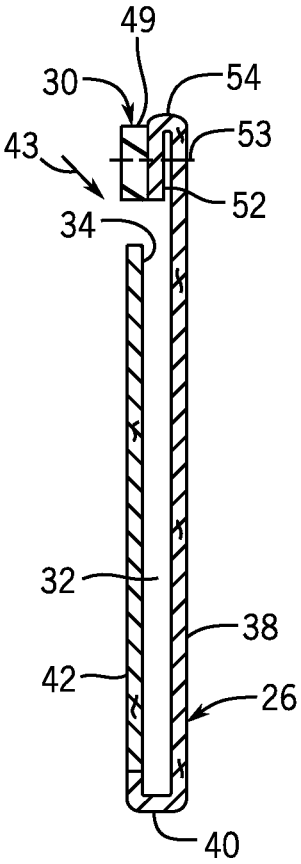
FIG. 2
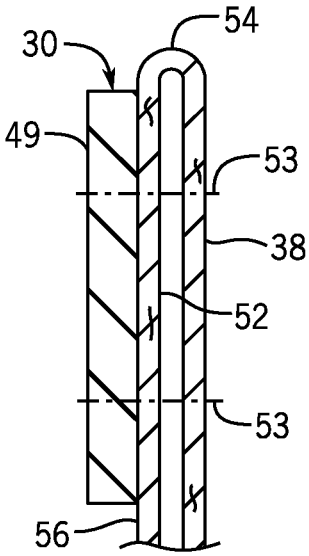
FIG. 2A
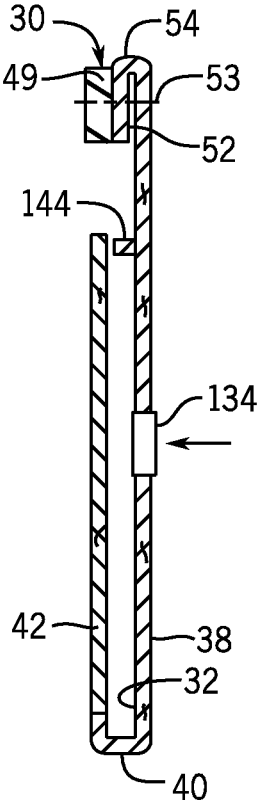
FIG. 3

RUNNING BELT

BACKGROUND

Running belts are worn by persons running or jogging, and carry water, food and other articles such as smart phones, keys, cards and cash. Unfortunately, existing running belts may be bulky and unnecessarily heavy.

BRIEF DESCRIPTION OF THE DRAWINGS

FIG. 1 is a top view of an example running belt while being worn.

FIG. 2 is a cross-section of the running belt of FIG. 1 taken along line 2-2.

FIG. 2A is an enlarged fragmentary view of a portion of the running belt of FIG. 2.

FIG. 3 is a sectional view of an example running belt taken along line 2-2 of FIG. 1.

Figure 4:
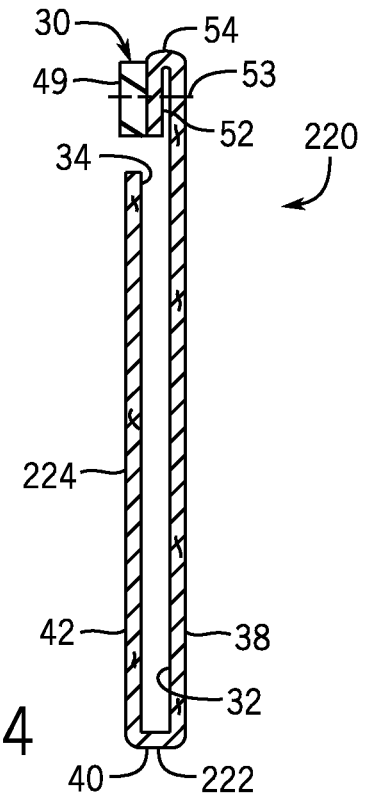
FIG. 4 is a sectional view of an example running belt taken along line 2-2 of FIG. 1.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example running belts that have a sleek and lightweight construction while still offering a large storage capacity. The example running belts eliminate excess material and weight while maintaining a smooth uninterrupted exterior having a reduced number of material edges or breaks.

The example running belts utilize a single panel that forms at least a portion of an enclosed storage volume. The single panel is inwardly folded to provide a smooth, rounded folded edge portion that is backed by a waist support. As a result, the waist support is covered and concealed, wherein in the running belt and the waist portion has a smooth rounded top edge without additional coverings or material breaks. The upper regions of the running belt may be thinner in construction, reducing the weight of the belt and potentially increasing comfort for the person wearing the belt.

Disclosed is an example running belt that may comprise a panel at least partially forming an enclosed volume having a mouth to receive articles. The panel has a front face and a folded edge portion. The running belt may further comprise a waist support to extend about the waist of a person wearing the running belt. The waist support comprises a band backing the folded edge portion, wherein the folded edge portion is secured to the front face and wherein the band is secured to the folded edge portion.

In some implementations, the panel has an outer portion forming a front of the enclosed volume, an inner portion forming a back of the enclosed volume and a lower folded portion connecting the outer portion in the inner portion. Such a construction reduces the amount of stitching and seams used to form the enclosed volume.

In some implementations, the inner portion is recessed below the folded edge portion, below the top edge of the outer portion. As a result, the top of the enclosed volume is concealed behind the outer portion of the panel. In some implementations, a second band is secured to and backs the upper edge of the inner portion. The second band strengthens those regions of the belt around an upwardly facing mouth for the enclosed volume. The second band further provides upper portions of the running belt with a uniform thickness on opposite sides of the upwardly facing mouth in that the outer portion of the panel, the folded edge portion of the panel and the waist support may have a three ply thickness and the opposite side of the mouth also has a three ply thickness formed by the outer portion of the panel, the inner portion of the panel and the second band.

In some implementations, the mouth faces in an upward direction. In other implementations, the mouth, providing access to the interior of the enclosed volume, faces in a frontwards or sideways direction.

In some implementations, the lower folded portion comprises a W-shaped fold forming the floor of the enclosed volume and having a folded peak between the outer portion and the inner portion. In some implementations, the folded peak is secured to the inner portion. The W-shaped fold forming the floor of the enclosed volume or pocket provides the running belt with a distinct floor and flatter profile.

In some implementations, front and inner portions of the panel are stitched or otherwise non-removably connected to one another to partition the larger enclosed volume at least partially formed by the panel into multiple distinct pockets or enclosed volumes. In some implementations, one or more pockets formed by the panel encircle the waist of the person wearing the running belt. In some implementations, one or more pockets formed by the panel extend along the portion of the running belt for positioning at the front or the rear of the runner, wherein portions of the waist support encircling the waist omit pockets or an enclosed volume.

In some implementations, the waist support comprise a continuous loop, lacking separable ends that may be selectively disconnected. In some implementations, the waist support has first and second opposite ends or end portions which are releasably connectable and separable from one another by a releasable connection mechanism such as a quick release buckle, snaps, a hook and loop fastener or the like.

For purposes of this disclosure, the term "coupled" shall mean the joining of two members directly or indirectly to one another. Such joining may be stationary in nature or movable in nature. Such joining may be achieved with the two members, or the two members and any number of additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members. The term "fluidly coupled" shall mean that two or more fluid transmitting volumes are connected directly to one another or are connected to one another by intermediate volumes or spaces such that fluid may flow from one volume into the other volume.

For purposes of this disclosure, the phrase "configured to" denotes an actual state of configuration that fundamentally ties the stated function/use to the physical characteristics of the feature proceeding the phrase "configured to." For purposes of this disclosure, the term "releasably" or "removably" with respect to an attachment or coupling of two structures means that the two structures may be repeatedly connected and disconnected to and from one another without material damage to either of the two structures or their functioning.

FIGS. 1 and 2 illustrate an example running belt 20. FIG. 1 is a top view of running belt 20 being worn about the waist 22 of a person. The belt is illustrated as being spaced from waist 22 merely for purposes of illustration. FIG. 2 is a sectional view of running belt 20 taken along line 2-2 of FIG. 1. Running belt 20 comprises panel 26 and waist support 30.

Panel 26 comprises a flexible panel of material that at least partially forms an enclosed volume 32 which has a mouth 34 to receive articles and providing access to the interior of the enclosed volume 32. Panel 26 may be formed from a variety of materials. In some implementations, panel 26 is formed from a fabric. In some implementations, panel 26 is formed from a polymer, synthetic materials or natural materials. In some implementations, panel 26 is opaque. In some implementations, panel 26 is at least partially translucent, facilitating viewing of the contents of the enclosed volume. In some implementations, panel 26 is formed from an elastic or resiliently stretchable material.

As shown by FIG. 2, the enclosed volume 32 is enclosed on a front side by an outer portion 38 of panel 26. The enclosed volume 32 is further bounded by floor 40 and a rear wall 42. In the example illustrated, enclosed volume 32 is accessible through a mouth 34 which faces in an upward direction in which receive articles in the direction indicated by the arrow 43. In some implementations, the floor 40 and the rear wall 42 are formed by panel 26. In some implementations, the floor 40 and the rear wall 42 may be formed by other panels joined to panel 26 by stitching, adhesives or the like.

Waist support 30 comprise a structure that encircles waist 22 and supports the remainder of belt 20 at waist 22. In some implementations, waist support 30 comprise a continuous loop formed by a single band 49 of material having first and second waist support ends that are non-releasably or releasably connected to one another. In some implementations, waist support 30 be formed by a first band that backs portions of panel 26 and one or more additional bands that are secured to the first band, and which do not back panel 26. In some implementations, waist support 30 is inelastic. In some implementations, waist support 30 is resiliently flexible and elastic. In some implementations, waist support 30 has an adjustable length to accommodate differently sized waists.

As shown by FIGS. 2 and 2A, panel 26 has a folded edge portion 52. Folded edge portion 52 integrally extends from outer portion 38 as a single unitary body with the remainder of panel 26. Folded edge portion 52 is inwardly folded, towards the interior of the loop formed by belt 20 when being worn, to form a rounded top edge 54. Folded edge portion 52 has an inner face 56 (facing waist 22 when belt 20 is worn) backed by band 49. In the example illustrated, folded edge portion 52 is vertically above and directly overlies both enclosed volume 32 and mouth 34.

As schematically indicated by a broken lines 53, folded edge portion 52 is secured to outer portion 38 of panel 26 and the band 49. In some implementations, folded edge portion 52 is sandwiched between outer portion 38 and the band 49 by one or more stitches that pass through such layers. In some implementations, the band 49 is stitched to folded edge portion 52 by first stitch and folded edge portion 52 is stitched to the front face 50 of panel 26 by second stitch. In some implementations, a single stitching passing through each of the band, the folded edge portion 52 and the outer portion 38 of panel 26 to secure such layers together. In yet other implementations, such layers may be held together by adhesives or welds. In some implementations, such layers may be individually held or secured to another by a combination of adhesives and stitches.

Because band 49 is joined to folded edge portion 52 on the inside of the loop of running belt 20, band 49 is concealed. Because folded edge portion 52 provides the front of belt 20 with a smooth rounded upper edge 54 without the use of an overlapping cover fabric, the front face 50 of panel 26 forms the entire front of belt 20, providing a smooth uninterrupted sleek appearance less likely to inadvertently catch or snag. The front of belt 20 omits any breaks or transitions between different layers of material. In addition, the overall complexity and weight of belt 20 is reduced.

FIG. 3 is a sectional view of running belt 120 taken along line 2-2 of FIG. 1. Running belt 120 is similar to running belt 20 described above except that the enclosed volume 32 is additionally bound by a cover or cover 144 and that the enclosed volume 32 is accessed through a front opening or mouth 134. Cover 144 may be formed by panel 26 or may be formed by additional panels of material stitched, welded, or bonded to panel 26 and/or those panels forming rear wall 42.

Mouth 134 provides access to the interior of enclosed volume 32 through front panel 26. Those portions of panel 26 about mouth 134 may be flexed or moved to widen mouth 134 during the insertion of an article into enclosed volume 32, where following such insertion, such portions resiliently flexed back to the original position and shape, capturing the article within the interior of the enclosed volume 32. In one implementation, mouth 130 comprises an elongate slit extending longitudinally (horizontally when belt 20 is being worn) along a portion of the length of panel 26. In some implementations, mouth 130 may comprise an elongate vertical slit through panel 26. In yet other implementations, mouth 134 may have other shapes, sizes, locations and/or orientations. In some implementations, mouth 134 may additionally include a closing mechanism such as a zip, hook and loop fastener, snap, buckle, button or the like releasably retaining mouth 134 in a closed state.

FIG. 4 is a sectional view illustrating running belt 220. FIG. 4 illustrates an example of how panel 26 may be used to form at least three sides of the enclosed volume 32. Running belt 220 is similar to running belt 20 described above except that the floor 40 and the rear wall 42, bounding enclosed volume 32, are also formed by panel 26. Panel 26 has a lower folded portion 222 and an inner portion 224 which form floor 40 and rear wall 42, respectively. Because the outer portion 38, floor 40 and inner portion 224 are each formed by the integral, single, construction of running belt 20 is simplified and the number of edges is reduced.

Figure 5:
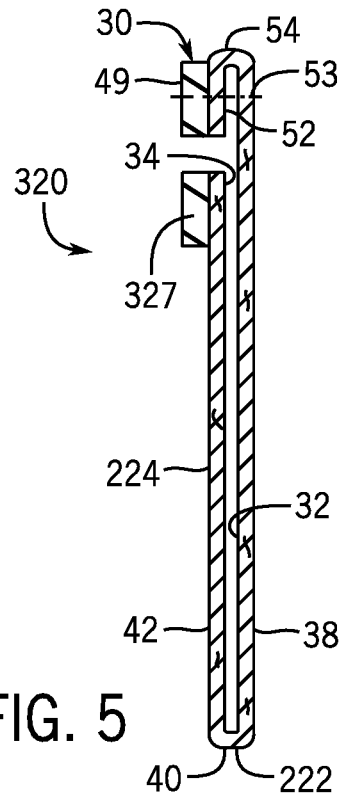
FIG. 5 is a sectional view taken along line 2-2 of FIG. 1.

FIG. 5 is a sectional view of running belt 320. Running belt 320 is similar to running belt 220 described above except that running belt 320 additionally comprises band 327. The remaining components of running belt 320 which correspond to components of running belt 220 are numbered similarly.

Band 327 comprise a strap or length of material extending along the inner or rear face of inner portion 224 of panel 26 adjacent to and below mouth 34. Band 327 backs the upper edge of inner portion 224 along mouth 34. Band 327 is vertically below band 49. In the example illustrated, band 327 is an upper edge at a vertical height no greater than 1 cm and nominally no greater than 0.25 cm the lower edge of band 39. As a result, the vertical spacing between bands 49 and 327 is sufficiently small such that the skin or other clothing of the person wearing running belt 320 is less likely to be pinched or caught between the lower edge of band 49 and the upper edge of band 327, providing a more comfortable experience for the person wearing running belt 320.

In some implementations, band 327 comprises a band of elastic material such as a spandex, Lycra or elastane fiber alone or in combination with other material such as nylon. In other implementations, other elastic materials may be utilized to form band 327 as well as band 49. In such implementations, band 49 may also be formed from an elastic material. In some implementations, band 49 is formed from the same elastic material that forms band 327. Because both band 327 and 49 are formed from the same or different elastic materials, both band 327 and band 49 may be in a slightly stretched state when running belt 320 is being worn, gripping the waist 22 of the person wearing running belt 320.

Figure 6:
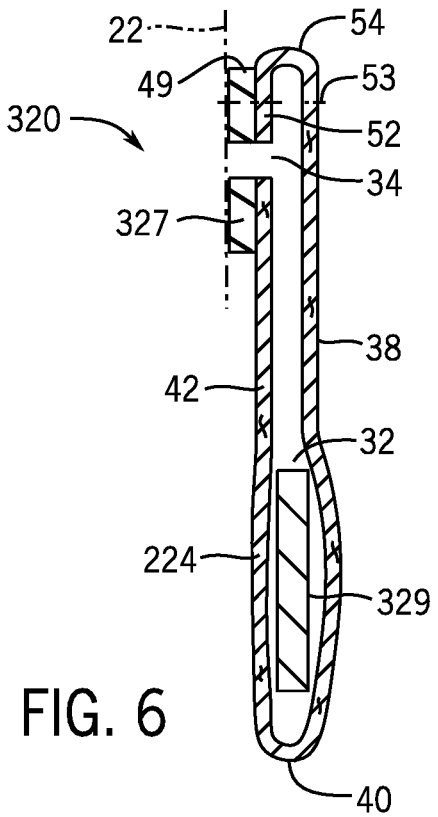
FIG. 6 is a diagram of the example running belt of FIG. 5 containing an example article while being worn.

FIG. 6 is a sectional view illustrating running belt 320 with enclosed volume 32 containing an article 329 and while running belt 320 is being worn about a waist 22 of a person. As shown by FIG. 6, because band 49 is elastic, band 49 resiliently closes about and against waist 22, closing mouth 34 overtop of enclosed volume 32. Because band 327 is elastic, band 327 resiliently closes about against waist 22 below band 49, further assisting in retaining mouth 34 in a closed state. Because both of such bands 327 and 49 are elastic, their inner faces both concurrently engage waist 22 in the same plane (as also shown by broken lines), reducing the likelihood of pinching of the skin are article between such bands. Because band 49 and band 327 are each part of a three-ply construction (three layers of material), the exterior running belt 320 remain flat smooth, omitting shoulders, edges or bumps. This consistent thickness that extends across both of bands 327 and 49 provides running belt 320 with a sleeker appearance when being worn.

Figure 7:
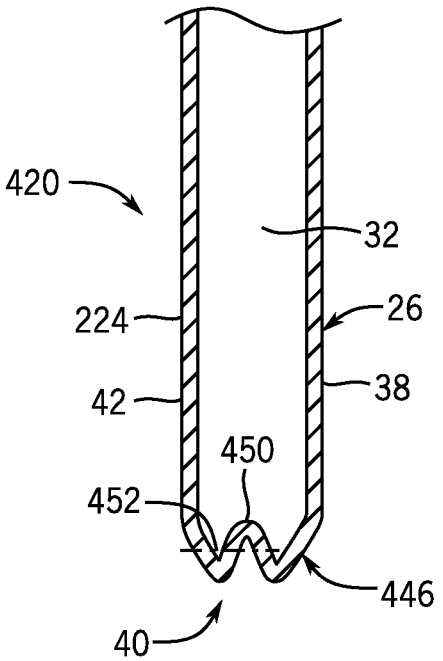
FIG. 7 large fragmentary sectional view illustrating portions of an example running belt.

FIG. 7 is an enlarged fragmentary sectional view of running belt 420. FIG. 7 illustrates an example of how the lower folded portion of running belt 420 may be configured for an enhanced shape and appearance. Running belt 420 is similar to running belt 320 except that running belt 420 comprises a lower folded portion 446 in lieu of lower folded portion 46. Those remaining components of running belt for 20 which correspond to components of running belt 320 are numbered similarly and/or are shown in FIGS. 1,5 and 6.

Lower folded portion 446 joins outer portion 38 of panel 26 to inner portion 224 of panel 26. Lower folded portion 446 forms the floor 40 of enclosed volume 32. Lower folded portion 446 comprises a W-shaped fold having a folded peak 450 between outer portion 38 and inner portion 224. The folded peak assists in maintaining the shape and size of floor 40. In the example illustrated, the folded peak 450 is secured to inner portion 224 as schematically indicated by broken line 452. In some implementations, broken line 452 schematically represents stitching through and between a lower portion of inner portion 224 and peak 450. Some implementations, broken line 452 schematically represents a weld, fusion or adhesive bonding or joining lower portion of inner portion 224 to peak 450. In other implementations, peak 450 may be secured to a lower portion of outer portion 38 of panel 26. In some implementations, peak 450 may freely float between outer portion 38 and inner portion 224.

Figure 8:
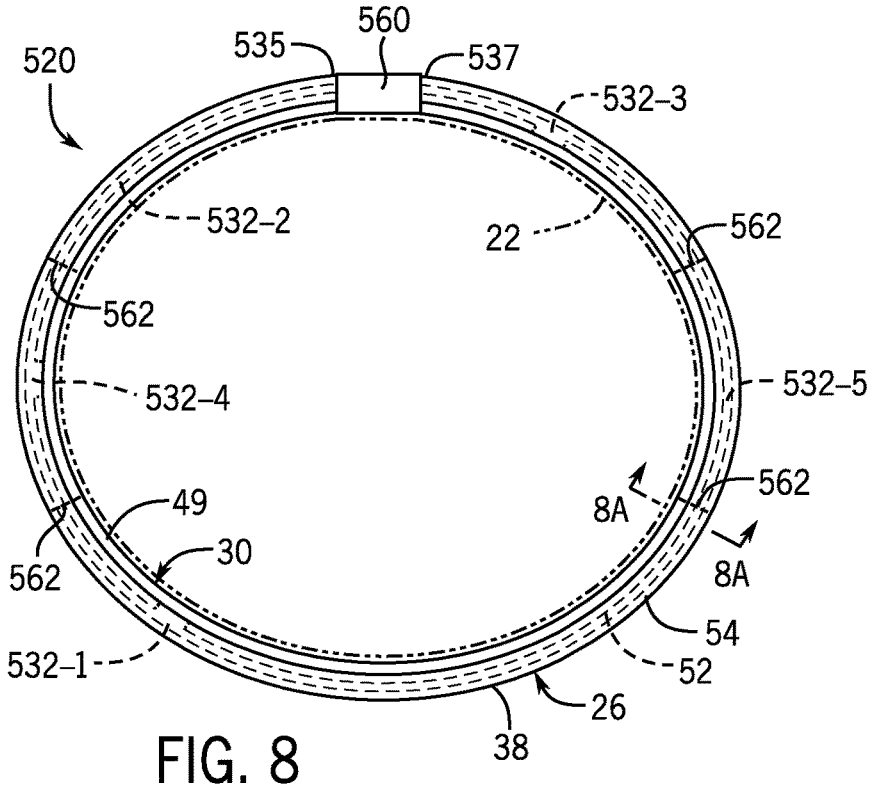
FIG. 8 is a top view of an example running belt while being worn.
Figure 8A:
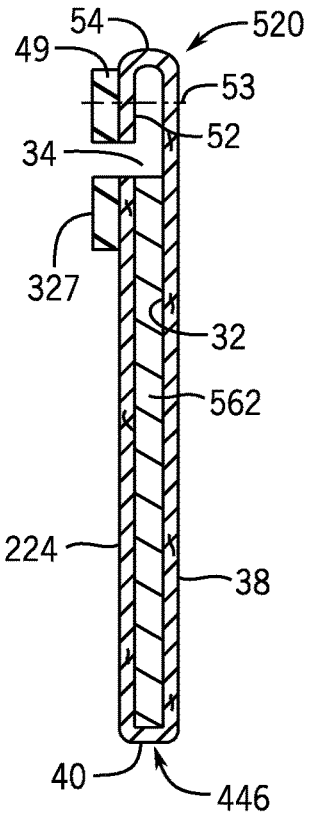
FIG. 8A is a cross-sectional view of the example running belt of FIG. 8 taken along line 8A-8A.

FIG. 8 is a top view of running belt 520 being worn about the waist 22 of a person. FIG. 8A is a cross sectional view of belt 520 taken along line 8A-8A. The belt is illustrated as being spaced from waist 22 merely for purposes of illustration. FIG. 8 illustrates an example of how the enclosed volume at least partially formed by panel 26 may be partitioned into different pockets. FIG. 8 further illustrates an example of how end portions of waist support may be releasably joined to one another to facilitate donning of the running belt 520. Running belt 520 is similar to running belt 420 except that running belt 520 is illustrated with enclosed volume 32 extending from a first end portion 535 to a second end portion 537, where such end portions 535 and 537 are releasably connected to one another by a releasable connector 560.

In the example illustrated, the enclosed volume 32 is partitioned into distinct pockets or pockets 532-1, 532-2, 532-3, 532-4 and 532-5 (collectively referred to as pockets 532). Each of pockets 532 directly underlies folded edge portion 52. Pocket 532-1 extends across the front of waist 22 while pockets 532-2 and 532-3 extend along the rear of waist 22. Pocket 532-2 extends between pocket 532-4 and connector 560. Pocket 532-3 extends between pocket 532-5 and connector 560. Pockets 532-4 and 532-5 form side pockets along the opposite sides of waist 22. Pocket 532-4 is formed between pocket 532-1 and 532-2. Pocket 532-5 is formed between pocket 532-1 and pocket 532-3. In some implementations, the relative positioning of such pockets 532 with respect to waist 22 may vary through the rotation of running belt 520 about waist 22. For example, running belt 520 way be rotated 180° such that connector 560 is positioned at the front center of waist 22 rather than at the rear center of waist 22.

Enclosed volume 32 is partitioned into the various pockets by partitions 562 extending between outer portion 38 of panel 26 and inner portion 224 of panel 26. In some implementations, partitions 562 may comprise stitching passing through and connecting outer portion 38 to inner portion 224. In some implementations, partitions 562 may comprise adhesives, welds or the like directly connecting opposite surfaces of outer portion 38 and inner portion 224. In yet other implementations, partitions 562 may comprise additional flexible panels may be located between and secured to outer portion 38 and inner portion 224 to define sides of such internal volumes or pockets. In some implementations, partitions 562 may be omitted such that the enclosed volume 32 continuously extends about the waist 22 between end portions 535 and 537. In some implementations, each or some of such pockets 532 may have covers 144 (shown in FIG. 3) formed by securing portions of outer portion 38 to inner portion 224 above the enclosed volume 32 by stitching, welds or adhesives, wherein panel 26 is provided with a mouth 134 (shown in FIG. 3) as described above.

Releasable connector 560 releasably joins end portions 535 and 537. In some implementations, releasable connector 560 comprises a quick release buckle. In some implementations, connector 560 comprises overlapping portions of a hook and loop (VELCRO) connector. In some implementations, connector 560 comprises a snap, a buckle, a button or other mechanisms for such releasable connection of end portions 535 and 537. In some implementations, connector 560 may be omitted such as where end portions 535 and 537 are non-releasably connected to one another such as by stitching, welds, adhesives or the like.

Figure 9:
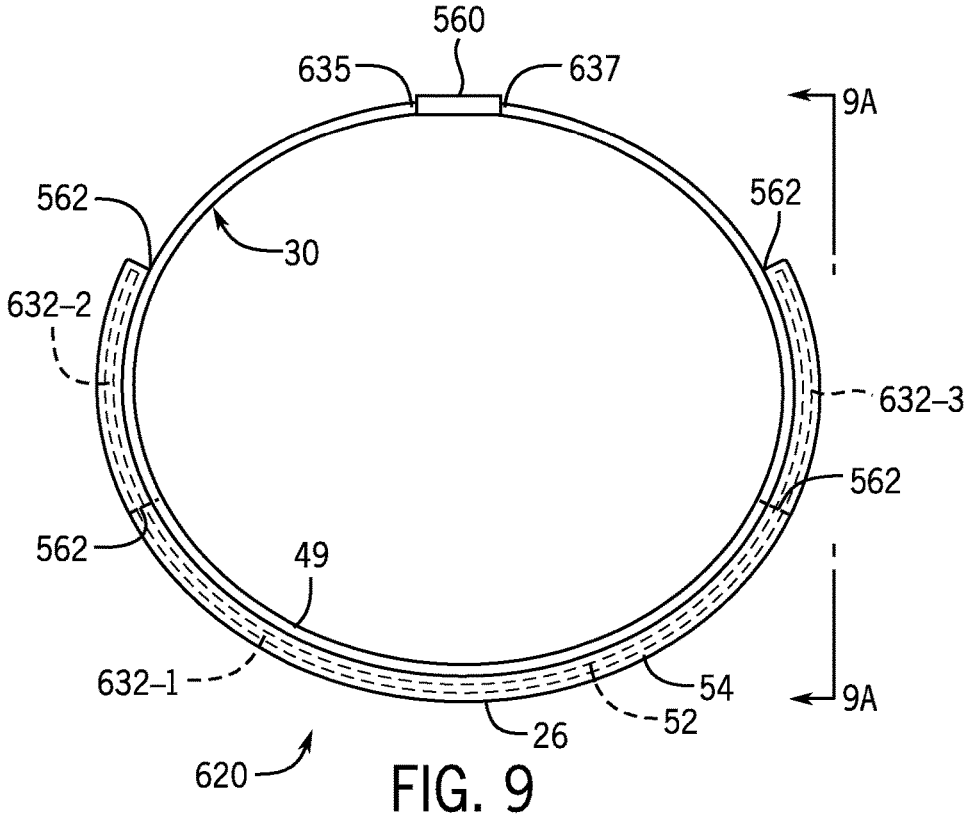
FIG. 9 is a top view of an example running belt while being worn.
Figure 9A:
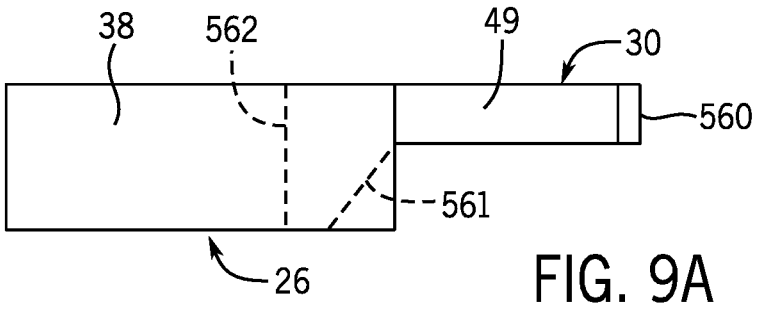
FIG. 9A is a side example running belt of FIG. 9 taken along line 9A-9A.

FIG. 9 is a top view of running belt 620 being worn about the waist 22 of a person. FIG. 9A is a side view of running belt 620 of FIG. 9 taken along line 9A-9A. The belt is illustrated as being spaced from waist 22 merely for purposes of illustration. FIG. 9 illustrates an example of how panel 26 may extend about a portion of the entirety of the person's waist 22 to provide pockets or other enclosed volumes about just a portion of a person's waist 22. FIG. 9 illustrates an example of how the enclosed volume at least partially formed by panel 26 may be partitioned into different pockets or pockets. FIG. 9 further illustrates an example of how the waist support may extend beyond panel 26 and beyond portions of the enclosed volume 32. Running belt 620 is similar to running belt 420 except that running belt 620 is specifically disclosed as having the construction shown in FIG. 9, wherein waist support 30 projects beyond ends of panel 26 and has end portions 635 and 637 releasably connected to one another by releasable connector 560 (described above). Those portions of running belt 620 extending along the front and sides of waist 22 that include panel 26 have a cross-sectional construction similar to that shown in FIG. 7.

As shown by FIG. 9, panel 26 and enclosed volume 32 extend 240 degrees about waist 22. Panel 26 and enclosed volume 32 are partitioned by partitions 562 to form pockets 632-1, 632-2 and 632-3 (collectively referred to as pockets 632). Pockets 632-1, 632-2 and 632-3 are similar to pockets 532-1, 532-4 and 532-5, respectively. Waist support 30 extends beyond pocket 632-2 and 632-3 and includes end portions 635 and 637 releasably connected to one another by releasable connector 560. Although running belts 520 and 620 are each described as having a cross-sectional construction similar to that shown in FIG. 7, in other implementations, running belts 520 and 620 may alternatively have panel 26 provided as part of a cross-sectional construction similar to that shown in and described with respect to any of FIGS. 2-6.

Figure 10:
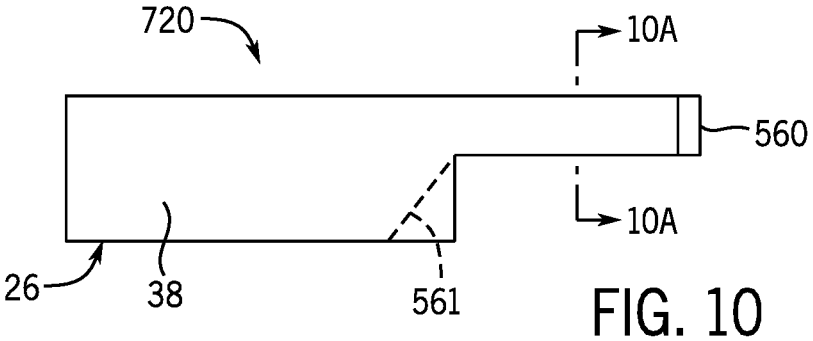
FIG. 10 is a side view illustrating portions of an example running belt.
Figure 10A:
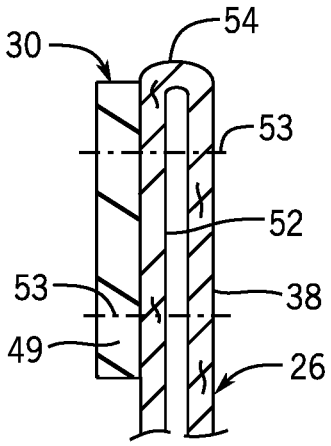
FIG. 10A is a sectional view of the running belt of FIG. 10 taken along line 10A-10A.

FIG. 10 is a side view of an example running belt 720, the side view as of FIG. 9A. FIG. 10A is a sectional view of running belt 720 of FIG. 10 taken along line 10A-10A. Running belt 720 is similar to running belt 620 except that front portion 38 and folded edge portion 52 of front panel 26 extend beyond pocket 632 and cover or overlap band 49 from the end of pocket 632-2 to connector 560 and from the end of pocket 632-2 to connector 560. The outer portion 38 of panel 26 extending between pockets 632-2 and 632-3 to connector 560 terminate at or below the lower edge of band 49. Such portions of panel 26 provide belt 720 with a continuous, uninterrupted transition between pockets 632 and the rearward portions of waist support 30 extending beyond such pockets 632. As indicated by broken lines 561 in FIGS. 9A and 10, in some implementations, pockets 632-2 and 632-3 may have chamfered or rounded rear edge portions provide a smoother or more gradual transition to those portions of running belt 520 which do not include pockets.

Figure 11:
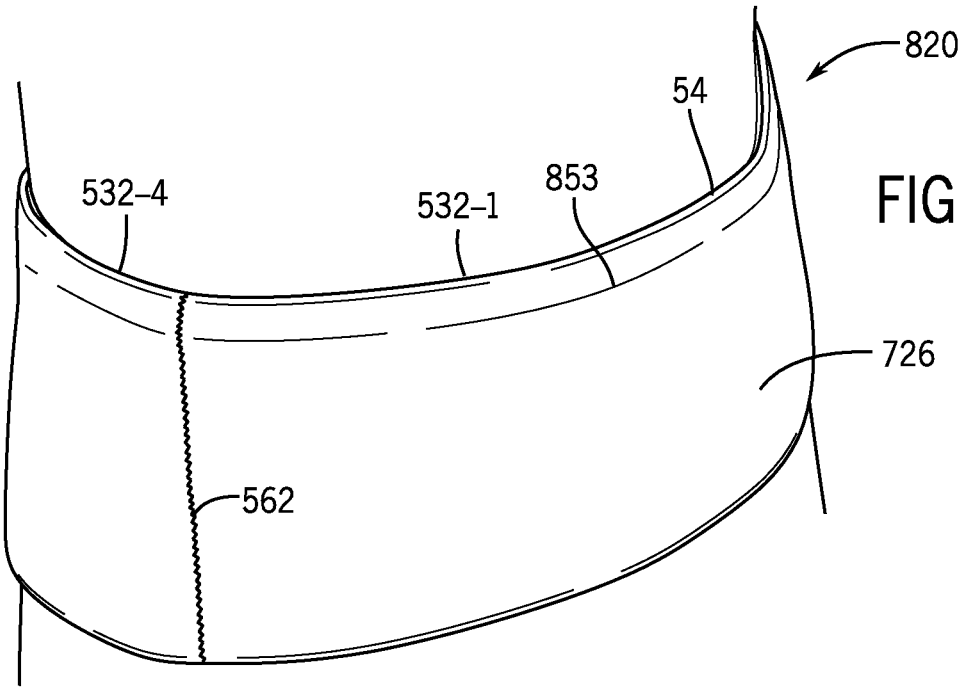
FIG. 11 is a perspective view of an example running belt while being worn.
Figure 12:
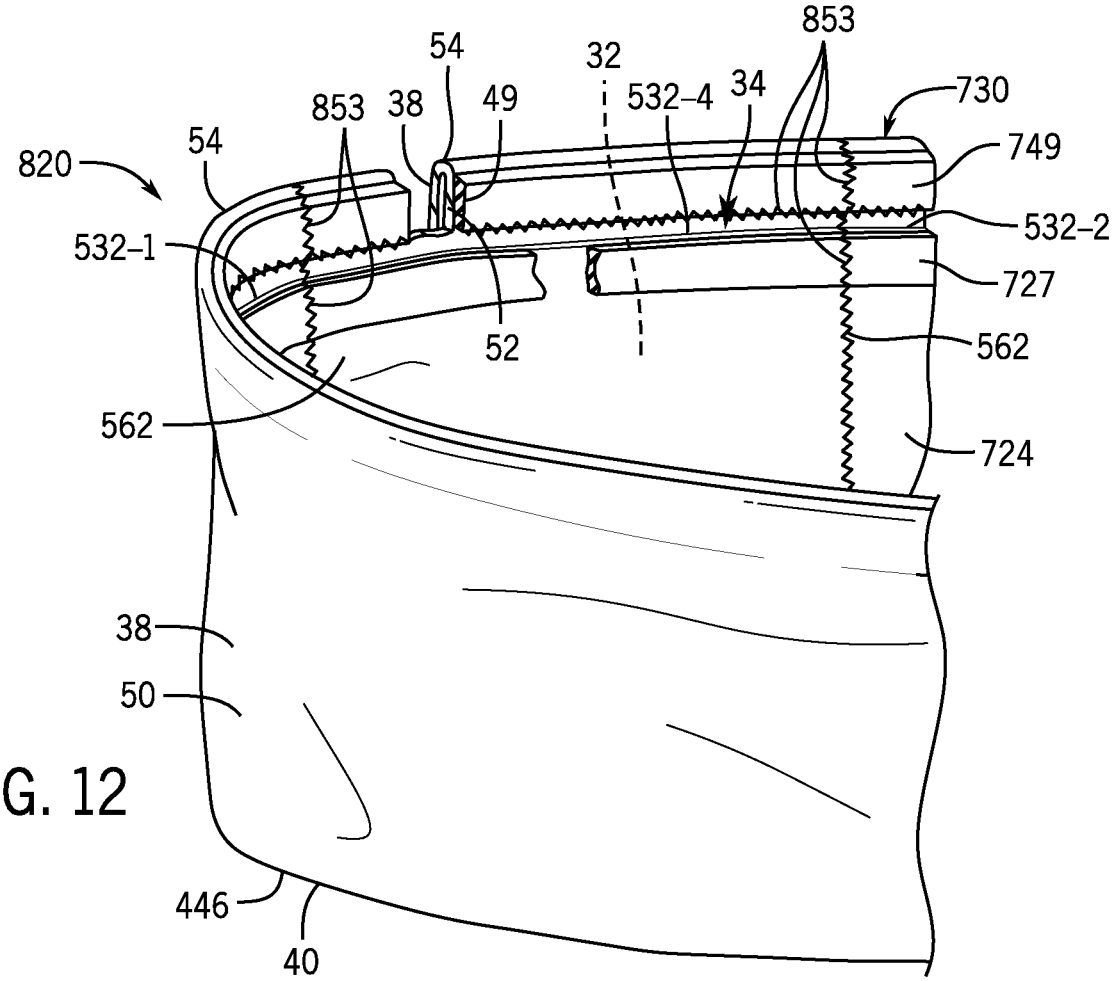
FIG. 12 is a perspective view of the running belt of FIG. 11 with portions broken or omitted for purposes of illustration.

FIGS. 11 and 12 are perspective views illustrating portions of an example running belt 820. Running belt 820 is similar to running belt 420 except that running belt 820 omits releasable connector 560, non-releasably connecting the end portions of the panel and bands forming the running belt. Those remaining components of running belt 820 which correspond to components of running belt 520 are numbered similarly. Portions of running belt 822 are shown broken away or are removed to illustrate the various layers of material. In the example illustrated, partitions 562 comprise stitching through outer portion 38 and inner portion 224. Bands 49 and 327 are further secured to portions of panel 26 by stitching. As shown by FIG. 11, running belt 820 is extremely thin and lightweight while offering a sleek and smooth outer face.

Figure 13:
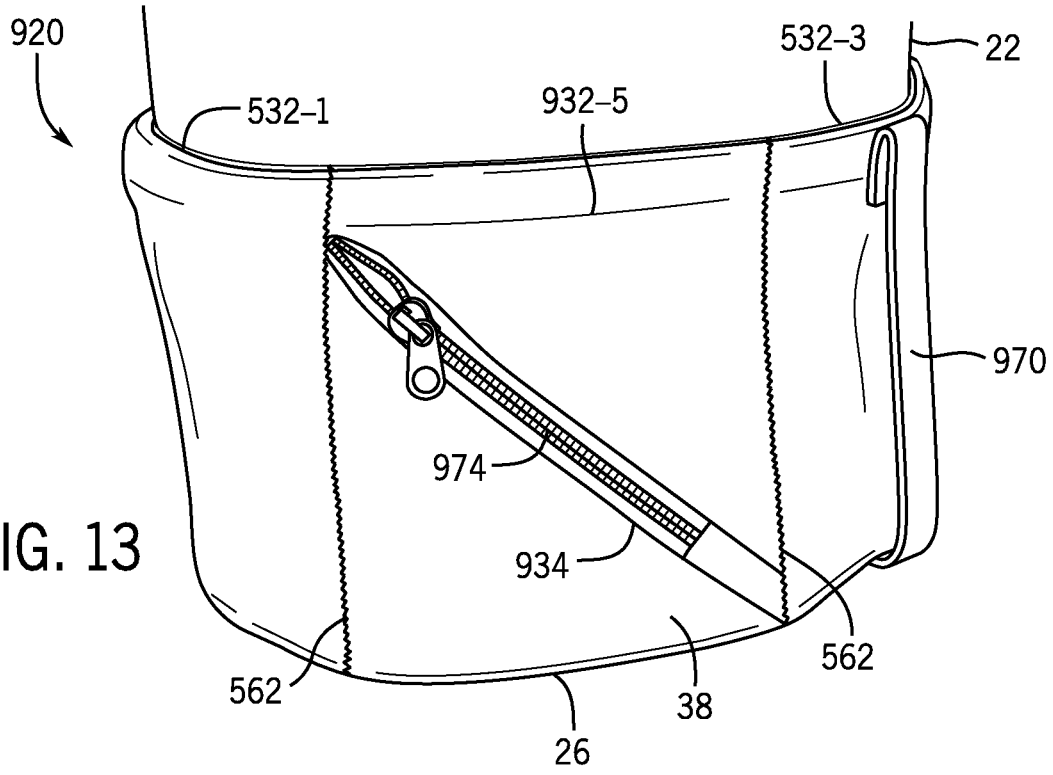
FIG. 13 is a perspective view of an example running belt.
Figure 14:
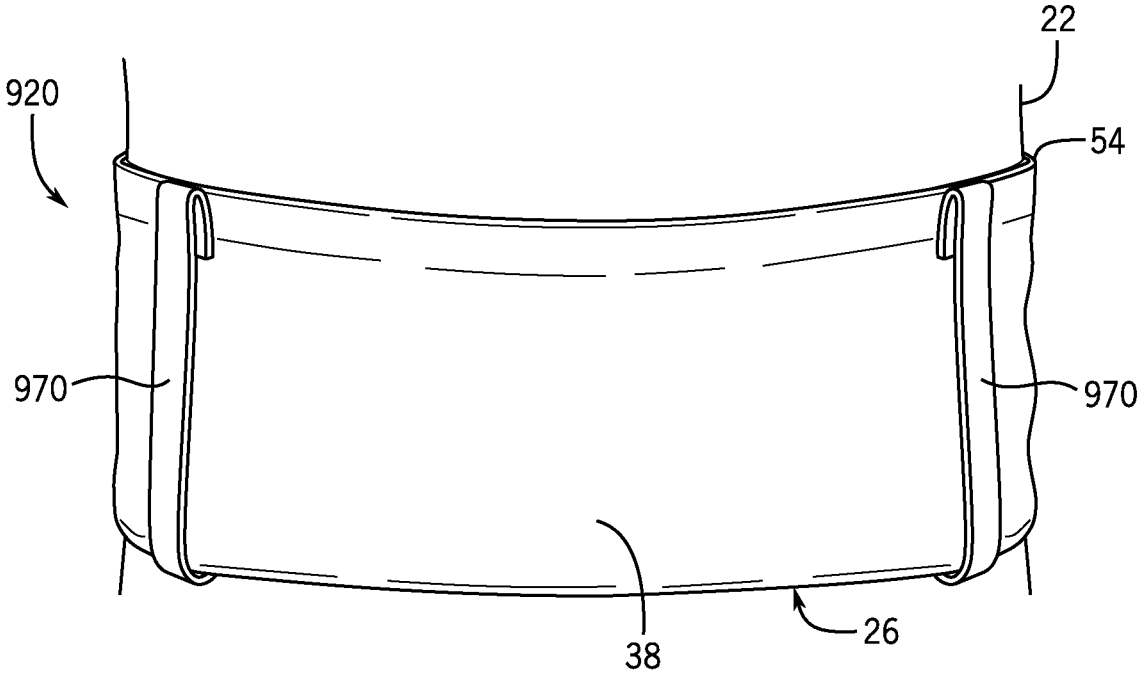
FIG. 14 is a perspective view of the example running belt of FIG. 13.

FIGS. 13 and 14 illustrate portions of an example running belt 920. Running belt 920 is similar to running belt 820 described above except that running belt 920 comprises side pocket 932-5 and rear carrying straps 970 those remaining portions of running belt 920 are numbered similarly and/or are shown in and described with respect to FIGS. 6, 7, 8, 11 and 12.

Side pocket 932-5 replaces pocket 532-5. Although not illustrated, side pocket 532-4 may also be replaced with a side pocket similar to side pocket 932-5. Side pocket 932-5 is similar to side pocket 532-5 except that side pocket 932-5 comprises a cover 144 (shown and described with respect to FIG. 3) and a mouth 934 having a closure 974. Cover 144 may be formed by securing portions of outer portion 38 to inner portion 224 above the enclosed volume 32 by stitching, welds or adhesives.

Mouth 934 comprises an opening formed in outer portion 38 of panel 26, providing access to the interior or enclosed volume 32 of pocket 932-5. In the example illustrated, mouth 935 comprises a diagonal opening. In other implementations, mouth 935 may comprise a vertical or horizontal opening through outer portion 38 of panel 26. Closure 974 comprises a mechanism to selectively open and close mouth 934. In the example illustrated, closure 974 comprises a zipper. In other implementations, closure 974 may comprise a flap or other piece of material having a hooked portion of a hook and loop fastener one side of mouth 934 and the looped portion of the hook and loop fastener on the opposite side of mouth 934. In other implementations, closure 934 may comprise a snap, buckle, button or other closing mechanism. In some implementations, pocket 932-5 may additionally omit cover 144, providing two ways of accessing the interior of pocket 932-5.

Rear carrying straps 970 comprise bands of elastic material having opposite ends stitched, bonded or welded to the outer portion 38 of panel 26 proximate to a top edge and bottom edge of running belt 920. Rear carrying straps 970 form at least two receiving and carrying articles, such as a water bottle, towel or the like adjacent the back the person wearing running belt 920. Some implementations, running belt 920 may include more than two straps 970 in some implementations, the two or more carrying straps 970 may be located at the sides along other portions of running belt 920. In some implementations, carrying straps 970 may be omitted.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first," "second," "third" and so on in the claims merely distinguish different elements and, unless otherwise stated, are not to be specifically associated with a particular order or particular numbering of elements in the disclosure.

What is claimed is:

1. A running belt comprising:

a panel at least partially forming an enclosed volume having a mouth to receive articles, the enclosed volume bounded by a rear wall having an upper edge portion, a front wall and a floor extending between the rear wall and the front wall, the panel having an outer portion forming the front wall and a folded edge portion having a downwardly facing edge;

a waist support to extend about a waist of a person wearing the running belt, the waist support comprising a band backing the folded edge portion, wherein the folded edge portion is secured to the outer portion and wherein the band is secured to the folded edge portion; and an access opening between the upper edge portion and the downwardly facing edge of the folded edge portion, the opening connected to the mouth between the upper edge portion and the downwardly facing edge of the folded edge portion.

2. The running belt of claim 1, wherein the panel further comprises an inner portion forming the rear wall of the enclosed volume and a lower folded portion connecting the outer portion and the inner portion and forming the floor of the enclosed volume.

3. The running belt of claim 2, wherein the lower folded portion comprises a W-shaped fold forming the floor and having a folded peak between the outer portion and the inner portion, wherein the folded peak is secured to the inner portion.

4. The running belt of claim 2 further comprising a second band secured to and backing the upper edge portion of the rear wall.

5. The running belt of claim 4, wherein the band and the second band are elastic.

6. The running belt of claim 5, wherein the band comprises first and second waist support ends that are connected to form a continuous loop to extend about a waist of a person wearing the running belt.

7. The running belt of claim 6, wherein the first and second waist support ends are non-releasably connected by bonding or stitching.

8. The running belt of claim 7, wherein the panel comprises first and second panel ends that are non-releasably connected to form a continuous panel loop to extend about the waist of the person wearing the running belt.

9. The running belt of claim 8, wherein the folded edge portion is secured to the outer portion by stitching and wherein the band is secured to the folded edge portion by stitching.

10. The running belt of claim 9, wherein portions of the outer portion of the panel and the inner portion of the panel are non-releasably connected to form a second enclosed volume having a second mouth to receive articles.

11. The running belt of claim 10, wherein second portions of the outer portion of the panel and the inner portion of the panel are non-releasably connected to form a third enclosed volume having a third mouth to receive articles, the second enclosed volume and the third enclosed volume extending on opposite sides of the enclosed volume.

12. The running belt of claim 11, wherein the panel forms a fourth enclosed volume having a fourth mouth to receive articles, the fourth enclosed volume extending between the second enclosed volume and the third enclosed volume, opposite the enclosed volume.

13. The running belt of claim 1, wherein the outer portion of the panel forms a frontmost surface of the running belt.

14. The running belt of claim 1, wherein the waist support comprises a second elastic band coupled to an end portion of the panel.

15. The running belt of claim 1, wherein the waist support comprises a connector to releasably connect end portions of the waist support to form a continuous loop.

16. The running belt of claim 1 further comprising a second band secured to and backing the upper edge portion of the rear wall, wherein the opening extends between the band and the second band.

17. The running belt of claim 16, where the second band is elastic.

18. A running belt comprising:

a panel at least partially forming an enclosed volume having a mouth to receive articles, the panel having an outer portion and a folded edge portion; and a waist support to extend about a waist of a person wearing the running belt, the waist support comprising a band backing the folded edge portion, wherein the folded edge portion is secured to the outer portion and wherein the band is secured to the folded edge portion, wherein the outer portion forms a front of the enclosed volume, and wherein the panel further comprises an inner portion forming a back of the enclosed volume and a lower folded portion connecting the outer portion and the inner portion and forming a floor of the enclosed volume, and wherein the lower folded portion comprises a W-shaped fold forming the floor and having a folded peak between the outer portion and the inner portion, wherein the folded peak is secured to the inner portion.

19. The running belt of claim 18, wherein the outer portion has a first upper edge and wherein the inner portion has a second upper edge below the first upper edge.

20. The running belt of claim 19, where the mouth is formed between the second upper edge and the outer portion of the panel.

* * * * *